US012768616B2

(12) United States Patent
Page et al.

(10) Patent No.: US 12,768,616 B2
(45) Date of Patent: Oct. 20, 2026

(54) APPARATUS AND METHODS FOR CARRYING HANDGUNS AND ACCESSORIES

(71) Applicant: ECOMMERCE INNOVATIONS L.L.C., Las Vegas, NV (US)

(72) Inventors: Brian A. Page, Las Vegas, NV (US); Nicholas M. Creech, Henderson, NV (US); Robert J. Bulan, Las Vegas, NV (US)

( * ) Notice: Subject to any disclaimer, the term of this patent is extended or adjusted under 35 U.S.C. 154(b) by 221 days.

(21) Appl. No.: 18/630,794

(22) Filed: Apr. 9, 2024

(65) Prior Publication Data

US 2025/0314452 A1 Oct. 9, 2025

(51) Int. Cl.
*F41C 33/02* (2006.01)

(52) U.S. Cl.
CPC ..... *F41C 33/0236* (2013.01)

(58) Field of Classification Search
CPC .... F41C 33/02; F41C 33/0209; F41C 33/046; F41C 33/00; F41C 33/0218; F41C 33/0227; F41C 33/0236; F41C 33/0245; F41C 33/041; F41C 33/048
See application file for complete search history.

(56) References Cited

U.S. PATENT DOCUMENTS

| | | | | |
|---|---|---|---|---|
| 4,645,103 | A * | 2/1987 | Bianchi | F41C 33/0227 D3/222 |
| 9,801,455 | B2 * | 10/2017 | Christoff | F41C 33/0209 |
| 11,612,190 | B2 * | 3/2023 | Webb | A41D 13/0015 2/115 |
| 11,800,906 | B2 * | 10/2023 | Furstenburg | A41D 19/01558 |
| 2004/0084494 | A1 * | 5/2004 | Gilliam | F41C 33/02 224/661 |
| 2006/0196907 | A1 | 9/2006 | Pruitt | |
| 2006/0219743 | A1 | 10/2006 | Gallagher | |
| 2018/0180380 | A1 | 6/2018 | Catner et al. | |

* cited by examiner

*Primary Examiner* — Corey N Skurdal
(74) *Attorney, Agent, or Firm* — Fast Forward Law, LLC; Brian P. Klein

(57) ABSTRACT

A holster allowing a handgun to be stowed includes an outside surface of a sticky rubber coating applied in a plurality of spaced areas. The sticky rubber coating is incapable of adhering to human skin and clothing. Each area of the plurality of spaced areas is separate from other areas of the plurality of spaced areas to expose an uncoated area of the substrate. The plurality of spaced areas of sticky rubber coating are capable of temporarily frictionally coupling the holster to a selected garment to transport the handgun when stowed in the holster.

20 Claims, 5 Drawing Sheets

APPARATUS AND METHODS FOR CARRYING HANDGUNS AND ACCESSORIES

BACKGROUND

The present disclosure relates to a holster for carrying handguns and accessories, and more particularly to a holster having an outside surface with a sticky rubber coating applied in a plurality of spaced areas capable of temporarily frictionally coupling the holster to a selected garment to transport the handgun or accessory when stowed in the holster.

Firearm users frequently carry their firearm with them using holsters. Traditional holsters are securely attached to an article of clothing worn by the user such as a belt, a harness, pants, or a vest. Attaching a holster in this way secures the firearm, but may interfere with holster removal and mounting the holster in other locations. These limitations of conventional holsters limit their effectiveness.

Recent holster developments include holsters having sticky or tacky material on the exterior of the holster, allowing the holster to be secured inside a pocket in the clothing or between the clothing and the user, such as inside the user's waistband. The tacky holster allows a user to move the between different sets of clothes without need for a specific holster mounting point and structure. But existing tacky holsters have the tacky material covering all of the holster's exterior surface. Not only is this tacky material coverage more than needed to hold the holster in position, covering the entire exterior of holster increases holster weight. Moreover, using tacky material on one entire face of the holster facing the garment uses a larger amount of tacky material than needed, increasing material cost. Additionally, uniformly applying the tacky material over the holster exterior retains the holster by simple friction but fails to take advantage of potential structural features to retain the holster in position when a user pulls the firearm from the holster. When the holster stays with the handgun, additional time may be needed to separate the gun and holster so the gun may be used.

In view of the numerous disadvantages and drawbacks of conventional holsters and existing tacky holsters, improvements are needed.

SUMMARY

In one aspect, the present disclosure includes a holster allowing a handgun having a size and shape to be stowed. The holster comprises a container having an inside surface and an outside surface opposite the inside surface. The inside surface of the container defines a hollow interior having a size and shape corresponding to a predetermined portion of the handgun to selectively receive the predetermined portion of the handgun when stowing the handgun in the holster. The outside surface of the container includes a substrate and a sticky rubber coating applied to the substrate in a plurality of spaced areas. The sticky rubber coating is incapable of adhering to human skin and clothing. Each area of the plurality of spaced areas is separate from other areas of the plurality of spaced areas to expose an uncoated area of the substrate, wherein the plurality of spaced areas of sticky rubber coating and the uncoated area of the substrate form the outside surface. The plurality of spaced areas of sticky rubber coating are capable of temporarily frictionally coupling the holster to a selected garment to transport the handgun when stowed in the holster.

In another aspect, the present disclosure includes a holster allowing an article having a predetermined size and a predetermined shape to be carried. The holster comprises a container formed from a laminate, including an inner layer having an inside surface and an outer layer having an outside surface opposite the inside surface. The inside surface of the container defines a hollow interior having a size and a shape corresponding to at least part of the article to selectively receive the at least part of the article and allowing the article in the holster to be carried. The outside surface of the container includes a substrate and a sticky rubber coating applied to the substrate in a plurality of spaced areas. The sticky rubber coating is incapable of adhering to human skin and clothing. Each area of the plurality of spaced areas is separate from other areas of the plurality of spaced areas to expose an uncoated area of the substrate. The plurality of spaced areas of sticky rubber coating and the uncoated area of the substrate form the outside surface. The plurality of spaced areas of sticky rubber coating are capable of temporarily frictionally coupling the holster to a selected garment to carry the article in the holster.

Other aspects of the present disclosure will be apparent in view of the following description and claims.

BRIEF DESCRIPTION OF THE DRAWINGS

This disclosure includes non-limiting examples illustrated in the accompanying drawings.

Corresponding reference characters indicate corresponding parts throughout the drawings.

DETAILED DESCRIPTION

Figure 1:
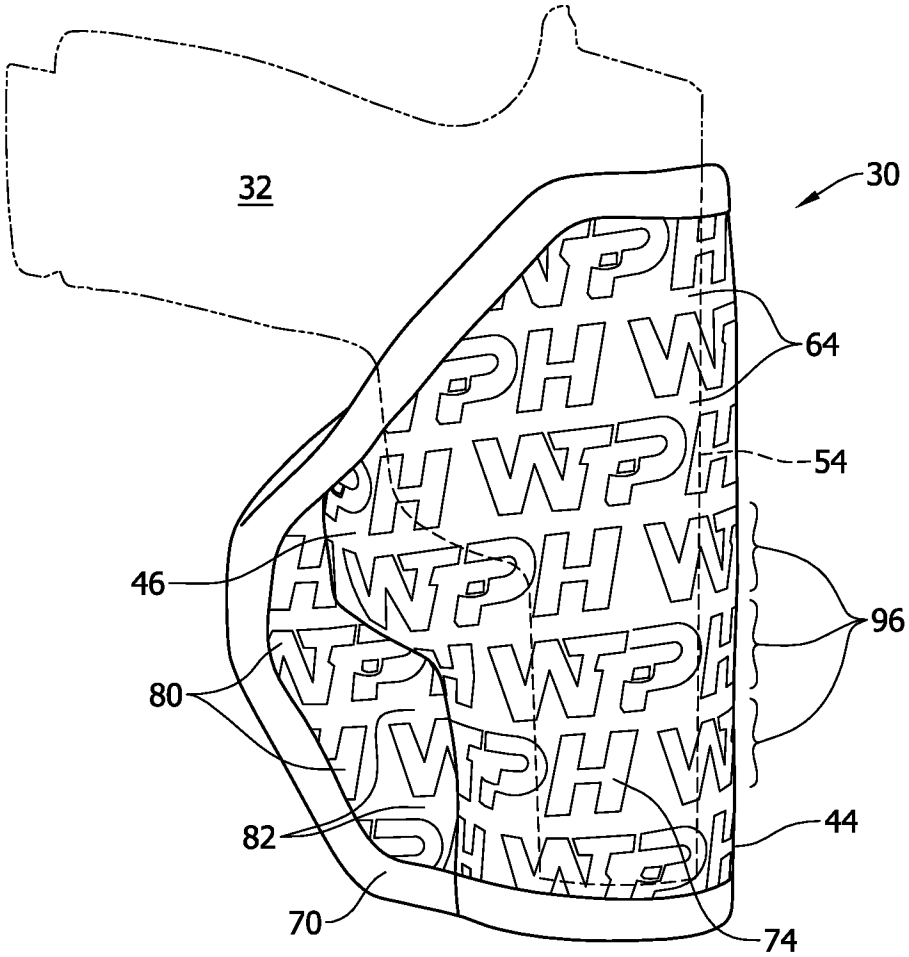
FIG. 1 is a side view of one example of a holster for holding a handgun.

FIG. 1 illustrates a first example of a holster designated in its entirety by the reference number 30. Although it is envisioned the holster 30 may have other configurations, such as for stowing gun accessories, ammunition magazines, knives, phones and other portable electronic devices, wallets, keys, and the like, the illustrated holster allows a handgun 32 to be stowed by temporarily frictionally coupling the holster to a selected garment 34 of a user 36, as will be described in more detail. Accordingly, inventive concepts and features disclosed herein are not intended to be limited to handgun holsters.

Figure 2:
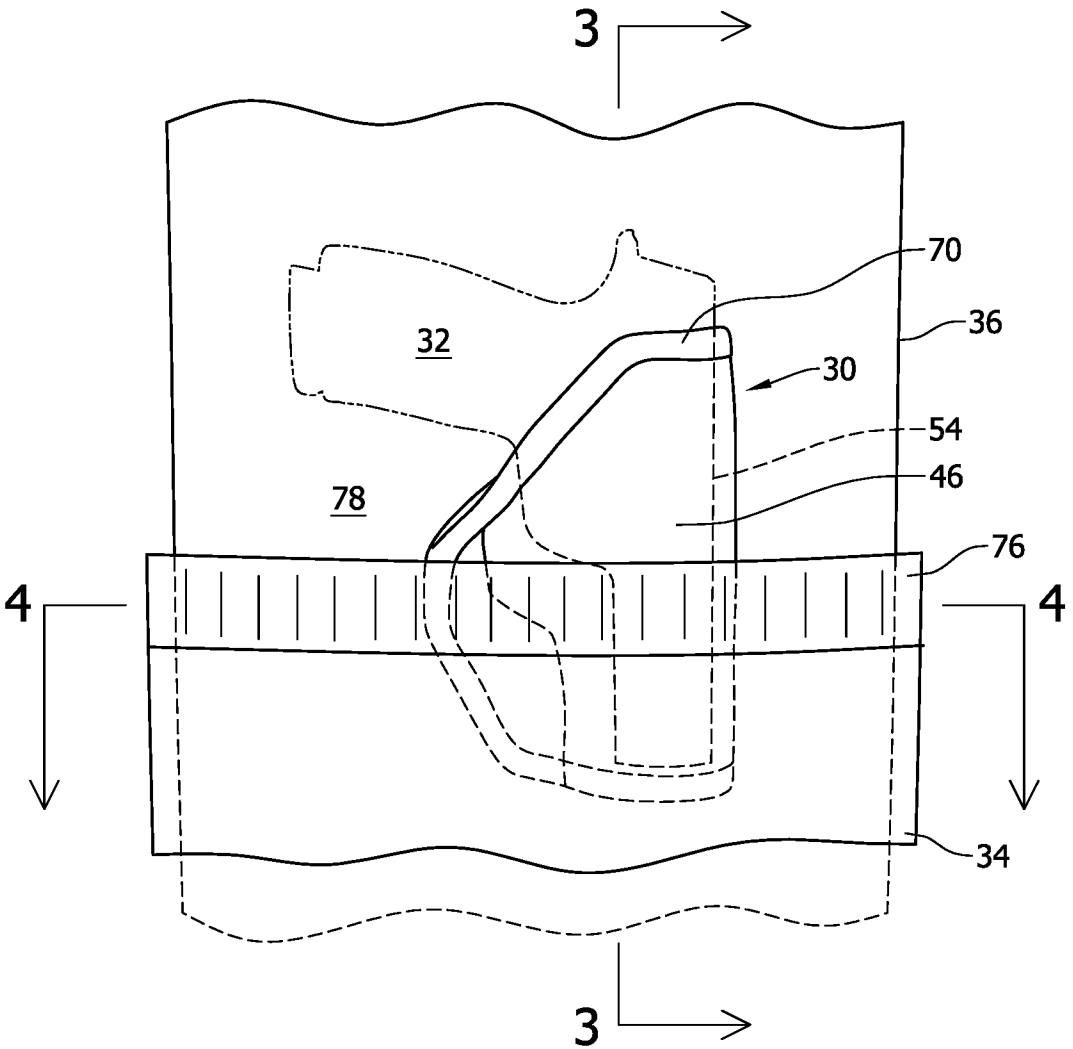
FIG. 2 is a side view of the holster of FIG. 1 shown in combination with a garment.
Figure 3:
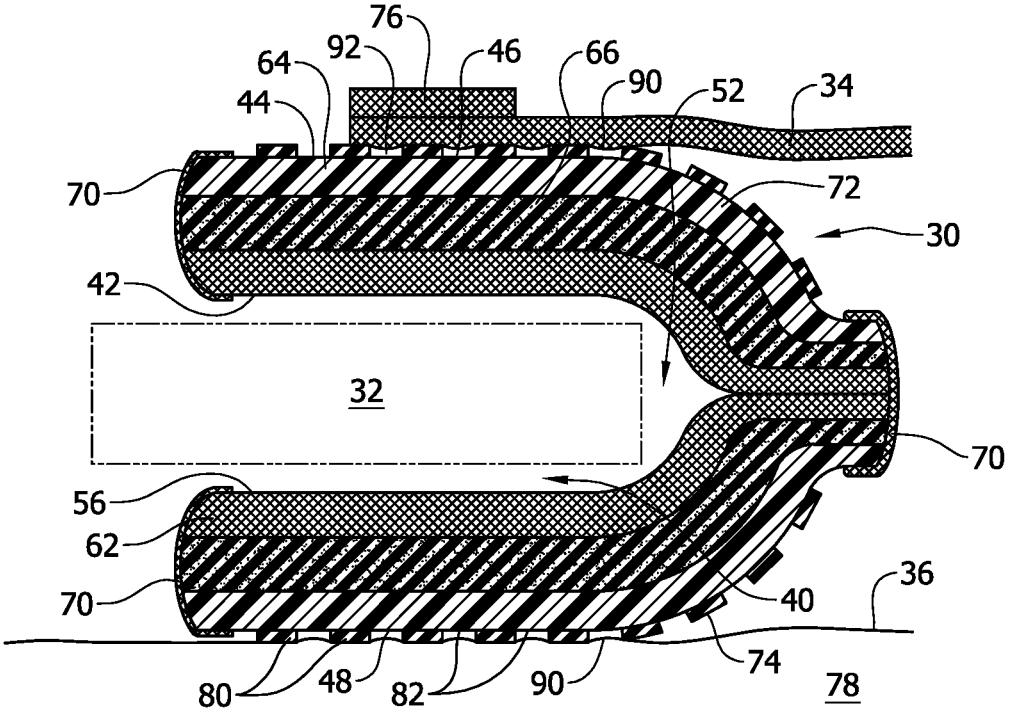
FIG. 3 is a fragmentary cross section of the holster of FIG. 1 taken along line 3-3 of FIG. 2.
Figure 4:
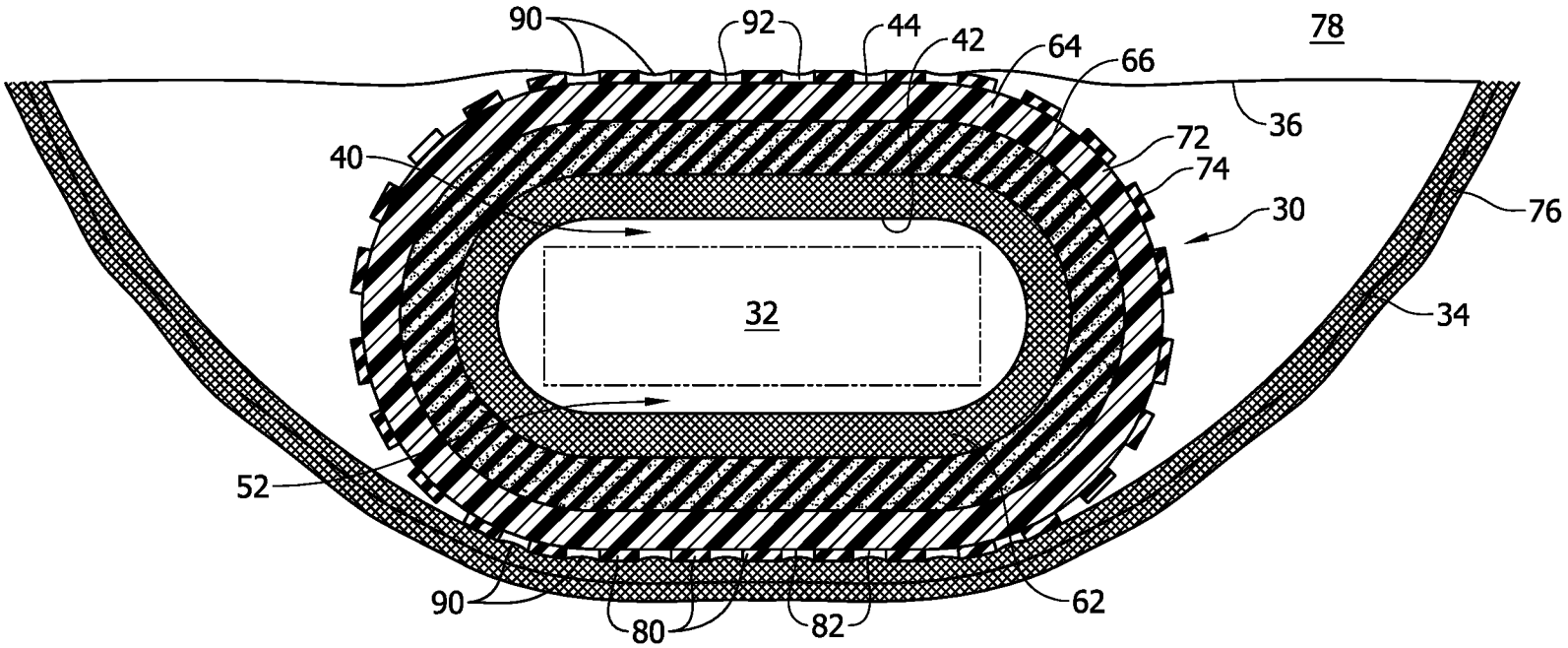
FIG. 4 is a cross section of the holster of FIG. 1 taken along line 4-4 of FIG. 2.

The illustrated handgun holster includes a container, generally indicated by 40 in FIGS. 3 and 4. The container 40 has an inside surface 42 and an outside surface 44 opposite the inside surface. The outside surface 44 of the container 40 defines a front face 46 and a rear face 48 of the holster 30. The inside surface 42 of the container 40 defines a hollow interior 52 having a size and shape corresponding to a predetermined portion 54 (see FIGS. 1 and 2) of the handgun 32 to selectively receive the predetermined portion of the handgun through an opening 56 when stowing the handgun in the holster 30. The holster may be entirely enclosed except the opening 56. Alternately, the holster 30 may include other openings, allowing a portion of the handgun 32

(e.g., the muzzle) to protrude from the holster or allowing access to a portion of the handgun while the handgun is retained within the holster. The container 40 of the holster 30 is sized and shaped generically to hold a variety of handguns or to closely match a particular handgun to provide an exacting fit. In both cases, the holster 30 is configured to receive and retain the handgun 32 when not in use but allow the handgun to be withdrawn from the holster when needed.

Figure 5:
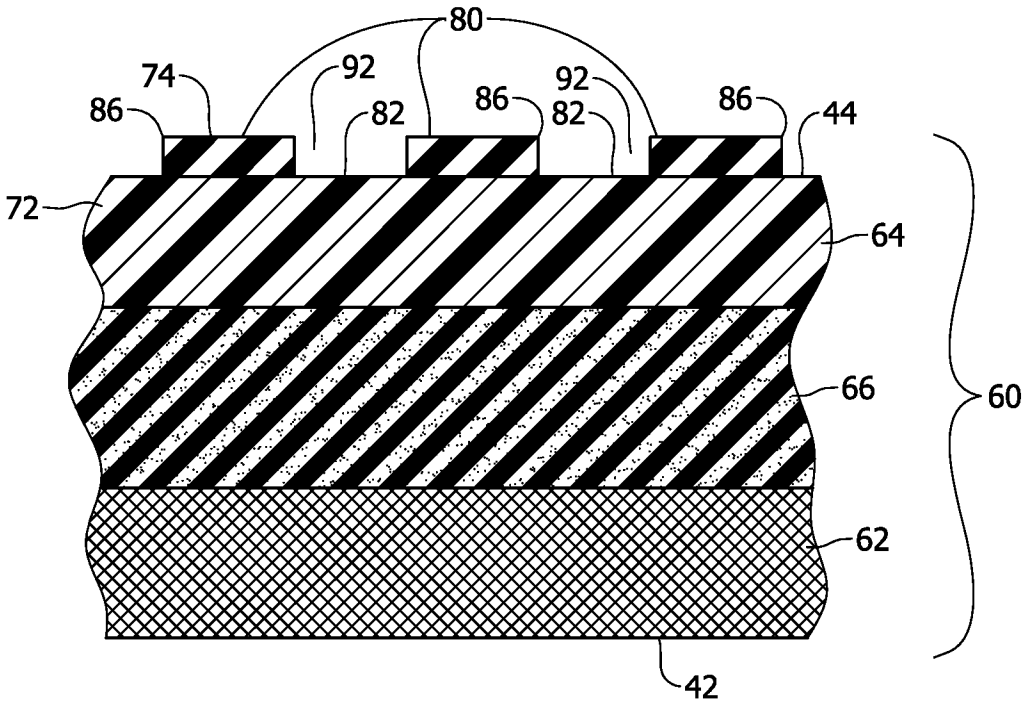
FIG. 5 is a detail of a laminate structure of the holster of FIG. 1.

The container 40 is constructed from a laminate, generally indicated by 60 (see FIG. 5), having an inner layer 62 including the inside surface 42 and an outer layer 64 including the outside surface 44. The inner layer 62 of the laminate 60 comprises a ballistic nylon in the illustrated holster 30. Although the illustrated inner layer 62 comprises ballistic nylon, those skilled in the art will appreciate the inner layer may be made from other suitable materials having sufficient durability to withstand the handgun being repeatedly inserted and withdrawn without showing wear. The outer layer 64 of the laminate 60 comprises a polyester in the illustrated holster 30. Although the illustrated outer layer 64 comprises a polyester, such as a 500D polyester fabric, those skilled in the art will appreciate the outer layer may be made from other suitable materials. The laminate 60 further comprises a cushioning interior layer 66 positioned between the inner layer 62 and the outer layer 64. The illustrated interior layer 66 comprises a foam, but those skilled in the art will appreciate the interior layer may be made from other suitable materials. It is envisioned that the specific order and number of layers in the laminate 60 described and shown may be modified. In addition, the thickness of the laminate 60, in particular layers 62, 64, 66, are increased relative to the size of the holster 30 in FIGS. 3-5 to provide detail, and one skilled in the art would understand that such layers may have other suitable thicknesses.

In the illustrated holster 30, the laminate 60 is folded as shown and corresponding edge margins are joined (e.g., sewn, riveted, or adhesively bonded). Further, an elastic edging 70 is attached (e.g., by sewing or adhesively bonding) over the joined edge margins of the laminate 60 to cover raw edges of the layers, as well as for joining the edge margins (see FIGS. 1-3). The layers 62, 64, 66 of the laminate 60 may be joined to one another in any conventional way, such as by an adhesive over all or a portion of their surface, or they may be held together via stitching or by the elastic edging 70. Once constructed, the laminate 60 structure may be pressed or molded to provide the resulting container 40 with a desired shape suitable for retaining a selected handgun when stowed and allowing the handgun to be drawn from the holster 30 when needed.

The outside surface 44 of the container 40 includes a substrate 72 (the polyester outer layer 64 in the illustrated example) having a sticky rubber coating 74 applied as shown in FIGS. 1, 3, and 4. The sticky rubber coating 74 comprises a material that does not adhere to or leave marks or residue on human skin and clothing. More specifically, the sticky rubber coating 74 comprises a material having a sufficiently high coefficient of friction to temporarily frictionally couple the holster 30 to a selected garment 34 and user 36 so the holster remains in position under typical conditions. In other words, the sticky rubber coating 74 comprises a material providing sufficient friction between the holster 30 and a garment 34 and between the holster and a user's skin to hold the holster in position when the garment or the garment and user's skin applies a typical normal force to the front face 46 and rear face 48 of the holster. For example, when a user 36 places the holster 30 between a waistband 76 of the garment 34 and the user's body 78 (FIGS. 2-4), the friction between the holster and the waistband and between the holster and user's body retains the holster in position. Although this connection is not permanent, the friction is sufficient to retain the holster 30 in position while holding a firearm and when drawing the firearm from the holster. Because the holster 30 does not permanently adhere to the human skin and clothing, the user may readily remove or reposition the holster. With the illustrated design, the user 36 may place the holster 30 in any number of additional places, such as in a pocket of clothing, within a pocket of a bag or backpack, or in any space where there is sufficient force normal to the front face 46 and rear face 48 of the holster so the friction between the holster and the surfaces it is sandwiched between retains the holster.

Although the illustrated sticky rubber coating 74 comprises silicone, those skilled in the art will appreciate the sticky rubber coating may be made from other suitable materials providing moderate stickiness or suitable frictional properties to facilitate retention of the holster 30 during use, without permanently adhering the holster to a garment or user. Material properties those skilled in the art will consider when tuning the sticky rubber coating 74 to the application include, but are not limited to, coefficient of friction, durometer, elongation, abrasion resistance, adhesion, rebound, flex cracking resistance, and brittle point. Those skilled in the art will also appreciate different materials may be used on different portions of the holster 30 to facilitate particular holster functions, including but not limited to, holster retention, user comfort, holster interoperability with differently sized garments, and holster interoperability with garments comprising different materials. The sticky rubber coating 74 is applied to the polyester outer layer 64 using a print jet in the illustrated holster 30. Those skilled in the art will appreciate the sticky rubber coating 74 may be applied with other suitable methods (e.g., stenciling).

The sticky rubber coating 74 is applied to the substrate 72 (i.e., outer layer 64) in a plurality of spaced areas 80 (FIGS. 1, 3, and 4). Each area 80 of the plurality of spaced areas is separate from other areas of the plurality of spaced areas to expose an uncoated area 82 of the substrate 72. Each area 80 of the plurality of spaced areas of sticky rubber coating 74 in the illustrated holster has a thickness of about 0.45 mm to about 0.50 mm, but those skilled in the art will appreciate the sticky rubber coating 74 may have other suitable thicknesses. Moreover, different portions of the holster 30 may be provided with a sticky rubber coating 74 having different thicknesses. The plurality of spaced areas 80 of sticky rubber coating 74 and the uncoated area 82 of the substrate 72 form the outside surface 44 of the container 40. The plurality of spaced areas 80 of sticky rubber coating 74 are capable of temporarily frictionally coupling the holster 30 to a selected garment 34 to transport the handgun 32 when stowed in the holster.

The illustrated plurality of spaced areas 80 and the uncoated areas 82 of the substrate 72 are applied in alternating patterns to provide advantages over prior holsters. Holsters known in the art have used a sticky material over substantially all of the exterior of the holster. Still other holsters known in the art have used a sticky material on one side of the holster while the other side is non-sticky. While these prior holsters have sticky surfaces, these surfaces are smooth, relying only on the inherent friction between the surfaces to retain the holster. In contrast, the alternating pattern of sticky rubber coating 74 and uncoated areas 82 of substrate 72 disclosed herein creates a notched, discontinuous outside surface 44 as shown in detail in FIGS. 3-5. Put another way, the spaced areas 80 of sticky rubber coating 74 create a series of sticky knobs or protrusions 86 protruding from the outside surface 44 of the holster 30. This series of surface discontinuities, or protrusions 86, allows portions of the garment 34, on the front face 46 of the holster 30, and portions of the human body 78 (or undergarment, not shown), on the rear face 48 of the holster 30, to form lobes 90 that enter the spaces 92 created between the protrusions 86. Thus, in addition to the friction created where the areas of sticky rubber coating 74 contact the garment 34 and user 36, the illustrated holster 30 is retained by the mechanical interaction or interdigitation between the protrusions 86 and the lobes 90 formed on the garment and user. Although not wishing to be bound by a particular theory of operation, when a force acts on the holster 30 parallel to its faces 46, 48, it is believed the interdigitated protrusions 86 and lobes 90 may under at least some circumstances provide greater resistance to movement between the corresponding interfacing surfaces compared to the smooth interfaces of the prior art. Similar to a knobby bike tire tread providing more traction when the edges of knobs have earth, rocks, or snow to push against, so too the illustrated holster 30 may have more ability to resist forces between its faces 46, 48 and the garment 34 and user 36 due to the interaction of the protrusions 86 and lobes 90, thereby improving selective retention of the holster. In contrast, prior holsters comprising substantially smooth, continuous sticky surfaces are less able to resist these forces. Moreover, because the interdigitation of the protrusions 86 and lobes 90 increases when pressure between the mating surfaces increases, it is envisioned that this discontinuous configuration facilitates intentional removal of the holster 30 from the user 36 and garment 34 when the pressure is relieved. Further, the illustrated holster 30 provides more retention when the holster is under increased pressure during normal use and less retention when the pressure decreases for removal.

The plurality of spaced areas 80 of sticky rubber coating 74 of the illustrated holster are arranged in a plurality of spaced rows 96 (see FIG. 1). Each row of the plurality of spaced rows is separated from an adjacent row of the plurality of spaced rows. Moreover, each row 96 and the adjacent row(s) extend parallel to each other. In one example, each row 96 and the adjacent row(s) are spaced by distance of about 6 mm to about 13 mm. Those skilled in the art will appreciate the plurality of spaced rows 96 may be skewed rather than parallel. For example, alternating rows 96 may slightly diverge or converge, creating a perspective parallel pattern. In another example, spaced rows 96 may be arranged in two or more sets of rows, creating an interference, crosswise, or waffle, pattern. Moreover, the ratio between the area of sticky rubber coating 74 and the uncoated area 82 is configured to be adjusted by one skilled in the art to facilitate increased or decreased retention of the holster 30 within the garment 34. In addition, the pattern of the sticky rubber coating 74 is configured to be adjusted to resist movement more in one direction than another direction, depending upon the orientation and use of the holster 30. As depicted in FIG. 1, the pattern of the sticky rubber coating 74 may also be arranged to create words or an image, such as a logo, on the outside surface 44 of the holster 30. It should be understood that the configuration of the sticky rubber coating 74 may vary from those described and shown here. Different arrangements and spacings of spaced areas 80 of sticky rubber coating 74 are contemplated.

As discussed previously, the holster 30 may be sized and shaped to carry a myriad of articles, including gun accessories, ammunition magazines, knives, phones and other portable electronic devices, wallets, keys, and identification cards.

When introducing elements in this description and the claims, the articles "a", "an", "the", and "said" are intended to indicate one or more of the elements. The terms "comprising", "including", and "having" are intended to be inclusive and indicate there may be additional elements other than the listed elements.

As those skilled in the art could make various changes to the above constructions, products, and methods without departing from the intended scope of the description, all matter in the above description and accompanying drawings should be interpreted as illustrative and not in a limiting sense. The patentable scope of the disclosure is defined by the claims, and can include other constructions and methods that would occur to those skilled in the art. Such other constructions are intended to be within the scope of the claims if the structural elements of the constructions do not differ from the literal language of the claims, or if the constructions include equivalent structural elements having insubstantial differences from the literal languages of the claims.

To the extent that the specification, including the claims and accompanying drawings, discloses any additional subject matter that is not within the scope of the claims below, the disclosures are not dedicated to the public and the right to file one or more applications to claims such additional disclosures is reserved.

The invention claimed is:

1. A holster allowing a handgun having a size and shape to be stowed, said holster comprising a container having an inside surface and an outside surface opposite said inside surface, said inside surface of the container defining a hollow interior having a size and shape corresponding to a predetermined portion of said handgun to selectively receive said predetermined portion of the handgun when stowing the handgun in the holster, said outside surface of the container including a substrate and a sticky rubber coating applied to the substrate in a plurality of spaced areas, creating a series of protrusions protruding from the outside surface of the holster, said sticky rubber coating being incapable of adhering to human skin and clothing, each protrusion associated with a spaced area of said plurality of spaced areas being separate from other protrusions associated with other areas of said plurality of spaced areas to create spaces between the protrusions configured to allow portions of the human skin and clothing to form lobes and adapted to receive said lobes formed on the human skin and clothing in said spaces, wherein said series of protrusions and spaces between the protrusions form said outside surface that has a notched, discontinuous configuration of surface discontinuities, wherein said plurality of spaced areas of sticky rubber coating form an alternating pattern of protrusions and spaces between the protrusions capable of temporarily frictionally coupling and retaining the holster to a selected garment by the mechanical interaction or interdigitation between the protrusions and the lobes formed on the human skin and clothing to transport the handgun when stowed in the holster.

2. A holster as set forth in claim 1, wherein each area of said protrusions of sticky rubber coating comprises a silicone.

3. A holster as set forth in claim 2, wherein each area of said protrusions of sticky rubber coating has a thickness of 0.45 mm to 0.50 mm.

4. A holster as set forth in claim 2, wherein said container is constructed from a laminate comprising an inner layer including said inside surface and an outer layer including said outside surface.

5. A holster as set forth in claim 4, wherein said inner layer of the laminate comprises a ballistic nylon.

6. A holster as set forth in claim 4, wherein said outer layer of the laminate comprises a polyester.

7. A holster as set forth in claim 6, wherein the sticky rubber coating is applied to the polyester using a print jet.

8. A holster as set forth in claim 6, wherein said inner layer of the laminate comprises a ballistic nylon.

9. A holster as set forth in claim 7, wherein the laminate further comprises a cushioning interior layer positioned between the inner layer and the outer layer.

10. A holster as set forth in claim 9, wherein the cushioning interior layer comprises a foam.

11. A holster as set forth in claim 9, further comprising an elastic edging surrounding the laminate.

12. A holster as set forth in claim 1, wherein said protrusions of sticky rubber coating are arranged in a plurality of spaced rows.

13. A holster as set forth in claim 12, wherein:

each row of said plurality of spaced rows is spaced from an adjacent row of said plurality of spaced rows; and said row and said adjacent row extend parallel to each other.

14. A holster as set forth in claim 13, wherein said row and said adjacent row are spaced by a distance of 6 mm to 13 mm.

15. A holster allowing an article having a predetermined size and a predetermined shape to be carried, said holster comprising a container formed from a laminate including an inner layer having an inside surface and an outer layer having an outside surface opposite said inside surface, said inside surface of the container defining a hollow interior having a size and a shape corresponding to at least part of said article to selectively receive said at least part of the article and allowing the article in the holster to be carried, said outside surface of the container including a substrate and a sticky rubber coating applied to the substrate in a plurality of spaced areas, creating a series of protrusions protruding from the outside surface of the holster, said sticky rubber coating being incapable of adhering to human skin and clothing, each protrusion associated with a spaced area of said plurality of spaced areas being separate from other protrusions associated with other areas of said plurality of spaced areas to create spaces between the protrusions configured to allow portions of the human skin and clothing to form lobes and adapted to receive lobes formed on the human skin and clothing in said spaces, wherein said series of protrusions and spaces between the protrusions form said outside surface that has a notched, discontinuous configuration of surface discontinuities, wherein said plurality of spaced areas of sticky rubber coating form an alternating pattern of protrusions and spaces between the protrusions capable of temporarily frictionally coupling and retaining the holster to a selected garment by the mechanical interaction or interdigitation between the protrusions and the lobes formed on the human skin and clothing to carry the article in the holster.

16. A holster as set forth in claim 15, wherein:

each area of said protrusions of sticky rubber coating comprises a silicone;

said protrusions of sticky rubber coating are arranged in a plurality of spaced rows;

each row of said plurality of spaced rows is spaced from an adjacent row of said plurality of spaced rows; and said row and said adjacent row extend parallel to each other.

17. A holster as set forth in claim 16, wherein said row and said adjacent row are spaced by a distance of 6 mm to 13 mm.

18. A holster as set forth in claim 15, wherein:

said inner layer of the laminate comprises a ballistic nylon; and said outer layer of the laminate comprises a polyester.

19. A holster as set forth in claim 18, wherein the laminate further comprises a cushioning interior layer positioned between the inner layer and the outer layer.

20. A holster as set forth in claim 19, wherein the cushioning interior layer comprises a foam having a thickness of 3 mm.

* * * * *